US011219806B2

(12) United States Patent
Rearden

(10) Patent No.: US 11,219,806 B2
(45) Date of Patent: Jan. 11, 2022

(54) MULTIPURPOSE POCKET-SIZED GOLFERS BALL MARKER TOOL WITH SPECIALIZED CLASP/HOOK

(71) Applicant: Kevin Rearden, Centreville, VA (US)

(72) Inventor: Kevin Rearden, Centreville, VA (US)

( * ) Notice: Subject to any disclaimer, the term of this patent is extended or adjusted under 35 U.S.C. 154(b) by 0 days.

(21) Appl. No.: 17/065,688

(22) Filed: Oct. 8, 2020

(65) Prior Publication Data

US 2021/0106891 A1 Apr. 15, 2021

Related U.S. Application Data

(60) Provisional application No. 62/973,572, filed on Oct. 11, 2019.

(51) Int. Cl.
*A63B 57/00* (2015.01)
*A63B 57/30* (2015.01)

(52) U.S. Cl.
CPC ..... *A63B 57/353* (2015.10); *A63B 57/357* (2015.10); *A63B 2220/20* (2013.01)

(58) Field of Classification Search
CPC .. A63B 57/353; A63B 57/357; A63B 2220/20
See application file for complete search history.

(56) References Cited

U.S. PATENT DOCUMENTS 3,834,030 A * 9/1974 Hanson ..... G01B 3/1084 33/759
4,273,329 A * 6/1981 Trigg ..... A63B 57/30 473/407
4,502,226 A * 3/1985 Hung ..... G01B 3/1084 33/760
4,880,232 A * 11/1989 Lang ..... A63B 57/357 473/176
4,960,278 A * 10/1990 Hainey ..... G01B 3/16 473/407
D332,573 S * 1/1993 Shekell ..... D10/72
6,089,500 A * 7/2000 Hafner ..... B65H 75/22 242/118.6
6,289,570 B1 * 9/2001 Peterson ..... B65H 75/14 144/14
6,491,594 B1 * 12/2002 Dacosta ..... A01B 1/24 473/408
6,604,543 B1 * 8/2003 Guo ..... B65H 75/40 137/355.26
8,684,867 B2 * 4/2014 Murphy ..... A63B 57/50 473/387
2008/0146367 A1 * 6/2008 Cruz ..... A63B 57/207 473/286
2009/0209369 A1 * 8/2009 Smith ..... A63B 57/207 473/406

(Continued)

*Primary Examiner* — Stephen L Blau

(57) ABSTRACT

A specialized tool for golfers, this invention is small enough to fit comfortably in a pocket, in the form of a ball marker, with a line long enough to be useful, and a custom-molded hook/clasp to hold it together neatly. In addition to being a ball marker, this unique combination of features provides the user the length, accuracy, and speed-of-use necessary for: determining which ball is closest to (or farthest from) the hole, whether a ball is in or out of bounds, and a thin, straight line for putting practice; without unduly delaying the pace of play on the golf course.

5 Claims, 3 Drawing Sheets

(56) References Cited

U.S. PATENT DOCUMENTS

| | | | | |
|---|---|---|---|---|
| 2009/0209370 | A1* | 8/2009 | Smith | A63B 57/50<br>473/408 |
| 2011/0207558 | A1* | 8/2011 | Huffman | A63B 57/207<br>473/406 |

* cited by examiner

MULTIPURPOSE POCKET-SIZED GOLFERS BALL MARKER TOOL WITH SPECIALIZED CLASP/HOOK

BACKGROUND OF THE INVENTION

This invention is a novel tool for golfers. It is a ball marker with 60 feet of line spooled inside of it, which is useful for several purposes.

The most common use for this line is compare distances between two or more balls on a putting green from the flagstick in the hole. Often, it is difficult to determine precisely which ball is closest, or farthest, without actually marking the exact length of line needed to reach one ball and then comparing this length with the position of the other ball. This is important in golf because the rules require that the player who is furthest away must putt first. Putting first can give an advantage to the other player by showing the slope of the green, i.e. how the ball will move as it rolls.

Also, oftentimes golfers will compete for a prize for who hits the ball onto the green closest to the hole, sometimes referred to as a "Greenie" or a Closest to the Pin Contest (CTP). This is another reason golfers must be able to accurately determine the closest.

The line is also useful for creating a straight line between two out-of-bounds (OB) stakes, to definitively determine if a ball is in or out of bounds. A third use for the line is to show a straight line for putting practice.

It is important to note that to be useful for these purposes, the line must be 60 feet long. Balls on greens can be 60 feet from the hole and OB stakes can be as far as 60 feet apart. It is not important that the line be automatically retractable with a spring, as there are other easy ways to rewind. It is important that the length of line be quickly deployable and accessed straight from the golfer's pocket, so as to not hold up the golfers playing behind.

Golfers routinely carry a coin-like object to mark their balls when on the green. It is required to mark a ball's exact location with a ball marker when lifting the ball for any reason, such as for cleaning before putting. Many golfers use a poker chip for a marker because it is small enough to fit comfortably in a pocket, while big enough to find easily in the pocket, and see easily from a distance when it has been laid on the green. This invention, the same diameter as a poker chip, can replace the ball marker that a golfer already carries while adding the capabilities provided by the spool of 60 feet of line.

There has been prior art apparatus for measuring the distance between a ball on a green and the flagstick, as illustrated in the patent to Trigg. U.S. Pat. No. 4,273,329. This apparatus included a spring to retract the line automatically, and was combined with a ballmark repair tool. There are problems with the practical use of this design. First, by incorporating a spring, the device could not accommodate 60 feet of line because the spring must be as long as the line and this would require too much space for a golfer to carry. Also the sharply pointed ballmark repair tool would be uncomfortable to carry. There was also no convenient way to secure the loose end when not in use. It is important in golf to play quickly and not hold up players behind, so to be useful, a distance-measuring tool like this must be accurate, long, and quickly and easily deployed right out of the golfer's pocket.

BRIEF SUMMARY OF THE INVENTION

The invention (the "Greenie String") solves the problems of inconvenience, accuracy, and taking too long for use on a golf course, by providing a long length of non-stretch line on a poker chip ball marker-sized spool held together with a clasp that simply pops off and hooks easily on to a flagstick, for a quick, easy and accurate determination of the closest ball. It is then easily rewound, snapped back together and replaced to the golfer's pocket. The invention also provides an easy, accurate way to determine out-of-bounds, and serves as a practice putting aid by providing a very thin, straight line that a ball can be putted along.

DETAILED DESCRIPTION OF INVENTION

Figure 1:
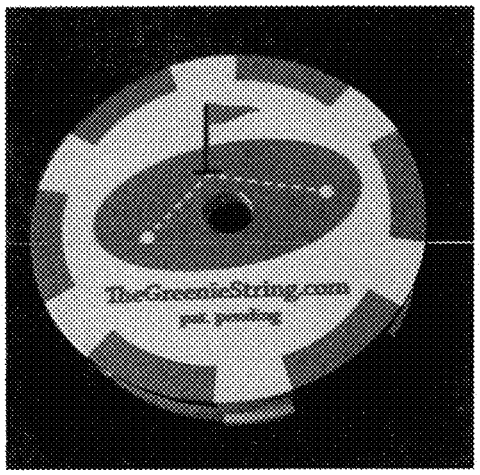
FIG. 1 Shows the invention from the top, as it looks when deployed as a ball marker or stored in a pocket.

As seen in FIG. 1, the Golfers Specialized Ball Marker/Spool apparatus fits together neatly into a poker chip-sized (1.5 inch diameter) cylinder that a golfer carries in his pocket and uses to mark his ball on each green. When the need arises to definitively determine which ball is closer to (or farther from) the hole, the golfer pushes the protruding nub end of the hook/clasp, causing it to expand slightly and pop off of the spool.

Figure 2:
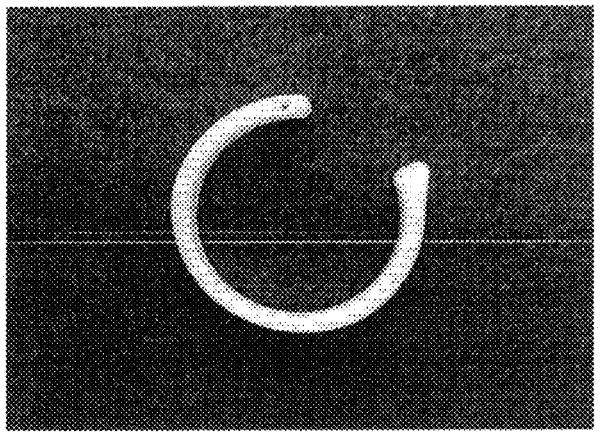
FIG. 2 Shows the Clasp/Hook from the top view

FIG. 2 shows that one end of the hook/clasp has this nub. The other end has a hole by which the line is attached. The sizes of the barrel and traverse are engineered to allow for 60 feet of non-stretch line, 0.08 mm in diameter, to fit between the barrel and the hook/clasp, and to minimize rewind time.

Figure 3:
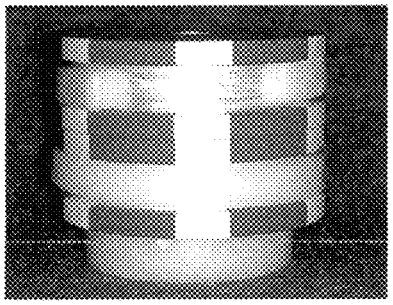
FIG. 3 Shows the Front (the top unit) and the Back (lower unit) of the invention with the Clasp in place on the spool of line.

FIG. 3 shows one apparatus stacked on top of another (on a separate barrel). The top apparatus shows the open end of the clasp and the line contained under it. The bottom apparatus shows the opposing view, with the closed side of the clasp covering the line.

With the hook off of the spool, the golfer places it on the bottom of the flagstick, then walks to the first ball to be compared, allowing the spool to spin as the line comes off. Some golfers will use fingers or a tee in the arbor hole for this unwinding, while others may simply hold the spool loosely in a closed hand and let it spin. Upon arriving at the first ball, the golfer pinches the line where it meets the ball, to mark the distance. Then the golfer walks around to the other ball(s) and compares the distances and declares which ball is closest or farthest.

Figure 4:
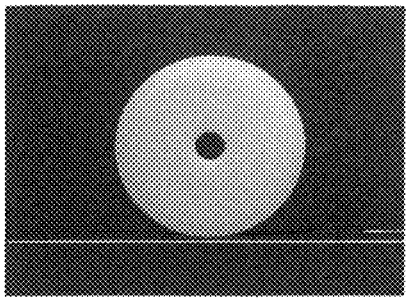
FIG. 4 Shows the top view of the barrel, with a diameter large enough to minimize winding, small enough to allow for 60 feet of line to fit.

After use, the golfer easily rewinds the device in one of several ways. Some golfers insert at tee into the arbor hole and spin the spool freely with a finger, rapidly taking up line. Alternatively, some golfers will simply hold one flange with the fingertips of one hand and hold the line loosely with the thumb and a finger of the other hand and then make circular motions with each hand to quickly get the line back onto the spool. A third option is to use one tee as an axle through the arbor hole and insert the tip of another tee into a small hole on the outer edge of the flange and then reel in the line using the second tee as a handle. Note that the barrel size is optimized to minimize the number of turns needed to recoup the line. See FIG. 4.

Figure 5:
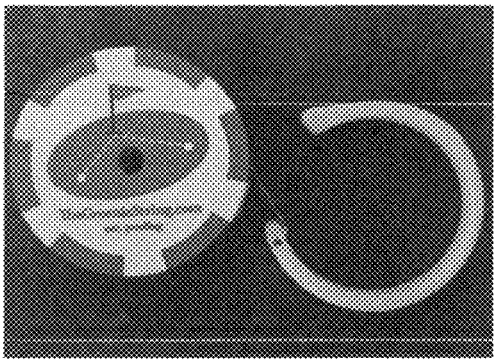
FIG. 5 Shows the top view of the invention with the Clasp/Hook popped off and ready to be deployed.
Figure 6:
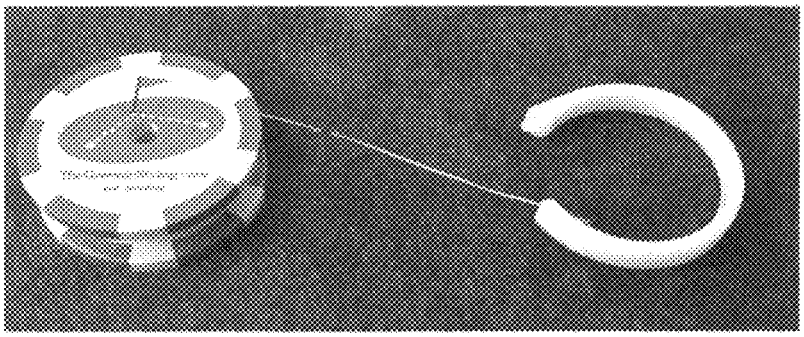
FIG. 6 Shows a perspective view of FIG. 5.
Figure 7:
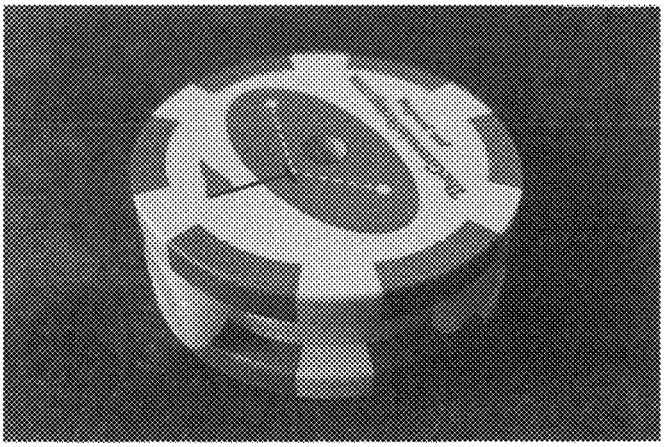
FIG. 7 Shows a perspective view of FIG. 1.
Figure 8:
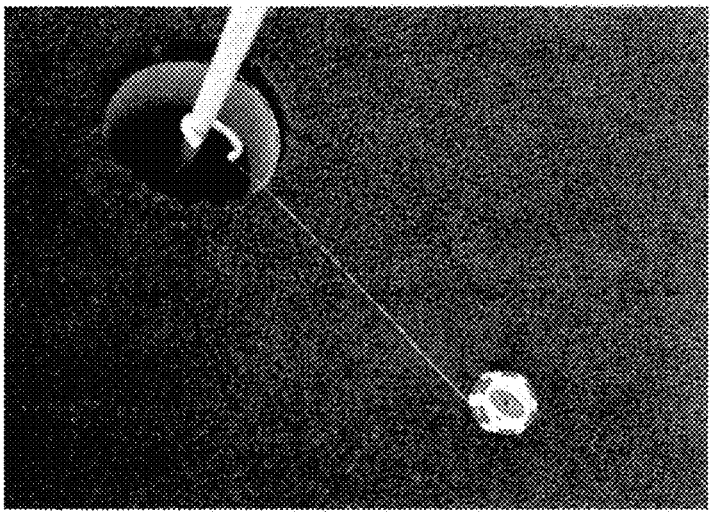
FIG. 8 Shows the invention with the Hook deployed on a flagstick on a golf green, ready to be spun out to compare distances between balls.

When all of the line is back on the spool, the golfer simply applies a bit of pressure on the hook/clasp causing it to expand around the line on the barrel and snap back into place, ensuring that the clasp is anchored against the line (facing backward) so that it will easily pop off for the next use without spinning around. See FIG. 5.

The same steps are taken when using the tool for Out-of-Bounds (OB) determination, except instead of hooking the hook onto a flagstick, the line is wrapped around the bottom of an OB stake with the hook taken under and then over the line to lock it in place while the spool is walked over to the next stake, establishing the exact OB line.

To use as a putting aid, the hook and line are deployed as above, with the hook end either attached to the mini flagstick on the practice green, or to a tee inserted into the ground directly behind the hole. After laying out the practice line, the spool is laid flat and secured to the ground with a tee. The ultra-thin line can then be putted on for practice.

Versions of the invention may have different colored dots on the line at various lengths (such as 12, 18, and 24 inches) that some golfers may want to use for establishing "Gimmes", which are lengths that all players have agreed in advance are short enough to concede without putting. There may also be small demarcations in black every inch, with every foot marked with a color in sets of ten feet. For example, every foot for the first ten feet has a green dot on the line, then each foot from 11-20 feet is demarcated in yellow, 21-30 in red, 31-40 blue, 50-60 orange. While it is generally not important to know the distances in feet and inches—only which ball is closer—some golfers may want these demarcations.

Another version may include a magnet with an indentation to allow for a smaller, thin metal ball marker to be attached on one side, as in some situations the spool as a ball marker could be too big. It is the applicant's intention in the following claims to cover all such variations and modifications as fall within the spirit and scope of the invention.

The invention claimed is:

1. An apparatus used by golfers comprising:

a spool having a barrel between two flanges, a first end of a line attached to the barrel of the spool, a C-shaped member attached to a second end of the line, the C-shaped member is flexible and is able to both act as a clasp that snaps into place over the line wound around the barrel between the two flanges and act as a hook that holds the second end of the line onto a flagstick when the spool is deployed, and the C-shaped member is entirely between the two flanges when acting as the clasp that snaps into place over the line wound around the barrel.

2. An apparatus of claim 1, wherein the spool has a diameter of a poker ship style ball marker and wherein the diameter is 1.5 inches.

3. An apparatus of claim 1, wherein the line is attached to one end of the barrel.

4. An apparatus of claim 1, wherein the line is 60 feet long.

5. An apparatus of claim 1, wherein the second end of the line is attached to a first end of the C-shaped member and a protruding nub is on a second end of the C-shaped member.

* * * * *